US006320304B1

(12) United States Patent
Mikita et al.

(10) Patent No.: US 6,320,304 B1
(45) **Date of Patent: *Nov. 20, 2001**

(54) APERTURE GRILLE HAVING PARALLEL SLITS WITH LARGER CROSS-SECTIONAL AREA GRIDS AT A PERIPHERAL PORTION

(75) Inventors: Akira Mikita; Yasuhiko Ishii, both of Tokyo (JP)

(73) Assignee: Dai Nippon Printing Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/102,519

(22) Filed: Jun. 22, 1998

(30) Foreign Application Priority Data

Jun. 24, 1997 (JP) ..... 9-167164

(51) Int. Cl.[7] ..... H01J 29/80
(52) U.S. Cl. ..... 313/402; 313/403
(58) Field of Search ..... 313/402, 403, 313/404, 407, 461, 462

(56) References Cited

U.S. PATENT DOCUMENTS

| | | | | |
|---|---|---|---|---|
| 3,652,895 | * | 3/1972 | Tsuneta et al. | 313/402 |
| 3,856,525 | * | 12/1974 | Inoue | 313/403 |
| 4,632,726 | * | 12/1986 | Thoms | 313/402 |
| 4,743,795 | * | 5/1988 | Thoms | 313/402 |
| 5,309,059 | * | 5/1994 | Kume et al. | 313/402 |
| 5,751,098 | * | 5/1998 | Ito et al. | 313/402 |
| 5,877,586 | * | 3/1999 | Aibara | 313/402 |

* cited by examiner

*Primary Examiner*—Nimeshkumar D. Patel
*Assistant Examiner*—Mariceli Santiago
(74) *Attorney, Agent, or Firm*—Dellett and Walters

(57) ABSTRACT

An aperture grille, in which tensile strength applied on the aperture grille after it is mounted on a frame body is made uniform to eliminate rupture of grid and variations in elongation caused by heat. The width of each slit on a display surface side and a rear side of the aperture grille is constant in longitudinal direction, and the width of each slit on the display surface side is designed smaller on peripheral portion than at the central portion so that cross-sectional area of each grid of the aperture grille is made larger on the peripheral portion than at the central portion.

1 Claim, 4 Drawing Sheets

APERTURE GRILLE HAVING PARALLEL SLITS WITH LARGER CROSS-SECTIONAL AREA GRIDS AT A PERIPHERAL PORTION

BACKGROUND OF THE INVENTION

The present invention relates to an aperture grille used for cathode ray tube in color television set or color display device, and in particular to an aperture grille of lightweight design.

In a cathode ray tube of a color television set or a color display device, various types of shadow masks and aperture grilles having slit-like apertures are used so that electron beam is irradiated to a predetermined fluorescent material.

An aperture grille has a number of slit-like apertures. In order to accurately maintain its shape, it is attached on a frame body made of cast iron under high tension, and it is then mounted on a cathode ray tube.

The larger the cathode ray tube is designed, the heavier the weight of the aperture grille becomes. Even when the weight of the aperture grille itself is not increased very much, the tension required for mounting is increased, and it is unavoidable that the increased weight of the frame body with the aperture grille mounted on it leads to heavier weight of the cathode ray tube.

To solve this problem, thin metal material is used to achieve more lightweight design. FIGS. 4(A) and 4(b) show an example of a conventional type aperture grille. FIG. 4(A) is to explain the aperture grille, and FIG. 4(B) represents a frame body for mounting the aperture grille.

An aperture grille 1 comprises slits 2 designed in parallel to a fluorescent material arranged on a fluorescent surface, and grids 3. An upper end 4 and a lower end 5 of the aperture grille 1 are attached on an upper frame body 7 and a lower frame body 8 of a frame body 6 by means such as welding. When the aperture grille is mounted on the frame body, tension is applied on the aperture grille. For this reason, welding is performed under the condition that a force is applied in such manner that a distance between the upper frame body 7 and the lower frame body 8 is decreased.

Although the upper frame body 7 and the lower frame body 8 are made of a material with high rigidity, it is unavoidable that deflection occurs on the upper frame body 7 and the lower frame body 8. Deflection is more likely to occur at the central portion 7B of the upper frame body than at an end 7A of the upper frame body, and it is unavoidable that the distance between the central portion of the upper frame body and the lower frame body is reduced. As a result, tension between the upper frame body and the lower frame body is unavoidably turned to uneven.

Tensile strength applied on each grid of the aperture grille mounted on the frame body is proportional to resilient force applied on the aperture grille. Similarly to the distribution of resilient force, tensile strength is lower at the center and higher at both ends.

With the increasing trend to produce the cathode ray tube in larger size and with finer accuracy, thin metal material is used in the production. With the distribution of tensile strength as described above, problems arise such as rupture of grid on the peripheral portion of the aperture grille, or variation of elongation caused by heat.

To solve the above problems, the present applicant previously filed JP-A-5-174707, which discloses that the aperture grille is produced in lightweight design, weight of each grid of the aperture grille is made heavier at peripheral portion than at the central portion, and portions other than the portion with apertures are designed thinner when it is produced by etching. When aperture grille is produced by this method, it is necessary to design a resist pattern suitable for the thin portion and etching condition must be adjusted to suit the formation of the thin portion as desired.

SUMMARY OF THE INVENTION

The present invention provides an aperture grille, in which width of each slit on a display surface side and a rear side of the aperture grille is constant in longitudinal direction, and width of each slit on the display surface side is designed smaller on peripheral portion than at the central portion so that cross-sectional area of each grid of the aperture grille is made larger on the peripheral portion than at the central portion.

DESCRIPTION OF THE PREFERRED EMBODIMENT

According to the present invention, on the front surface and the rear surface of an aperture grille, width of each slit and width of each grid are maintained constant in longitudinal direction of the slit, while width of each slit of the aperture grille is designed different between the front surface and the rear surface. The width of the slit on the display surface side is designed larger than that of the rear side, and width of the slit on peripheral portion is made smaller than that of the slit on the display surface side at the central portion. As a result, cross-sectional area of the grid of the aperture grille is increased from the central portion toward the peripheral portion.

In the present invention, the width of the slit on the display surface side is a value of the width of the slit measured on the surface of the display surface, and the width of the slit on the rear surface is a value of the width measured on the surface of the rear surface.

Figure 1A:
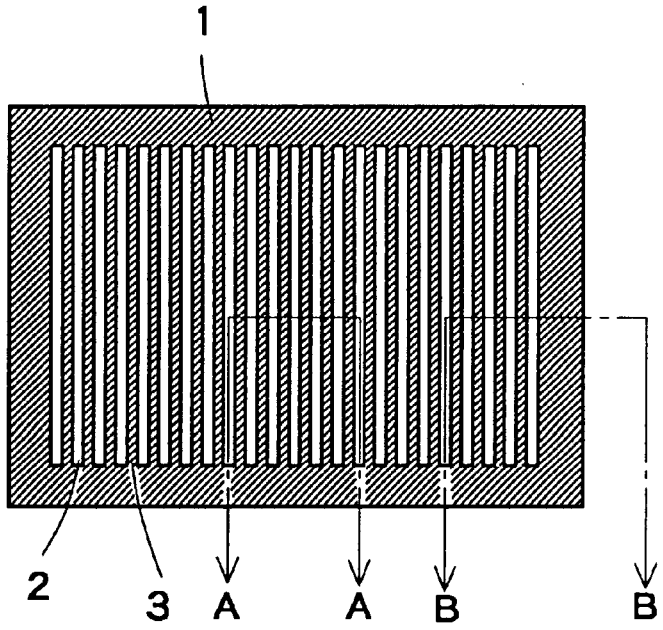
FIGS. 1(A)–1(C) are drawing to explain an embodiment of an aperture grille according to the present invention.
Figure 1B:
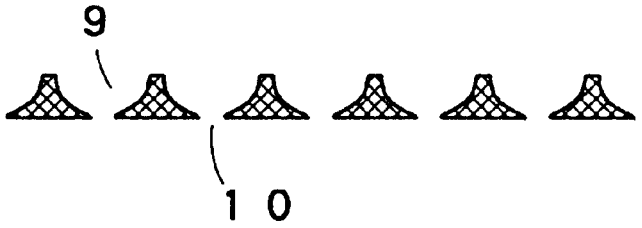
Figure 1C:
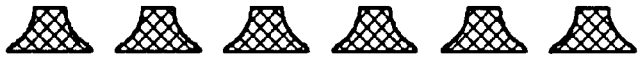

FIGS. 1(A)–1(C) show an aperture grille of an embodiment of the present invention. FIG. 1(A) is a plan view, and FIG. 1(B) represents a cross-sectional view showing cross-sections of grids at the central portion along the line A—A of the aperture grille shown in FIG. 1(A) FIG. 1(C) is a cross-sectional view showing cross-sections of grids on peripheral portion along the line B—B of the aperture grille shown in FIG. 1(A). In the grid 3 of the aperture grille 1, the width of a slit 9 on the display surface side is larger than the width of a slit 10 on the rear surface as shown in FIG. 1(B), and the width of the slit 9 on the display surface side of the grid on peripheral portion is smaller than the width of the slit at the central portion as shown in FIG. 1(C), and cross-sectional area of the grid 3 is larger.

It may be observed by reference to FIG. 1(A), that the slits extend substantially continuously from positions adjacent the upper end of the aperture grille and positions adjacent the lower end of the aperture grille, and, while the width of the slits varies with position on the display side, the width of the slits as observed from the rear of the aperture grille are substantially the same, whether in the center or at the edges of the aperture grille, as may be observed in FIG. 1(B) and FIG. 1(C).

Figure 2A:
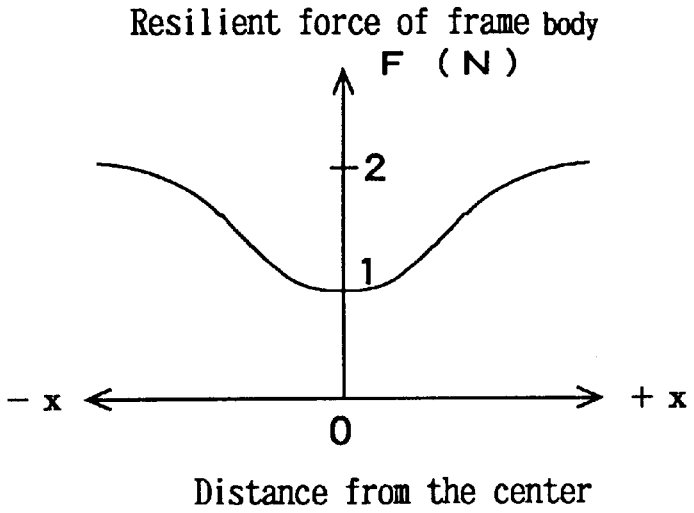
FIGS. 2(A)–2(C) is to explain how tensile strength is applied on the aperture grille of the present invention.
Figure 2B:
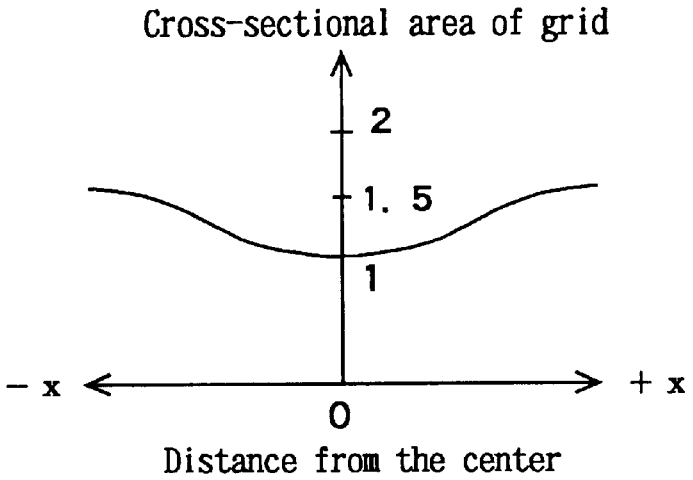
Figure 2C:
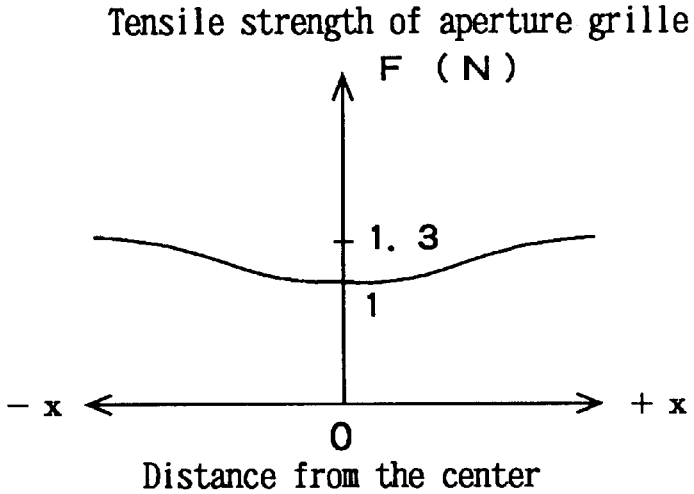
Figure 3A:
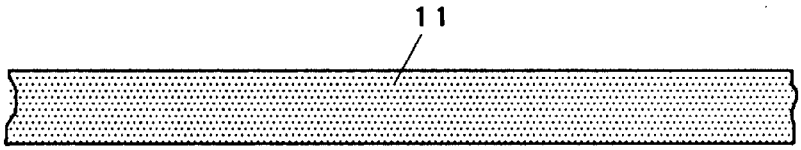
FIGS. 3(A)–3(F) show manufacturing process of the aperture grille of the present invention.
Figure 3B:
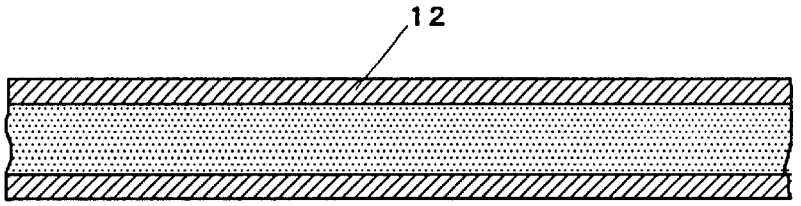
Figure 3C:
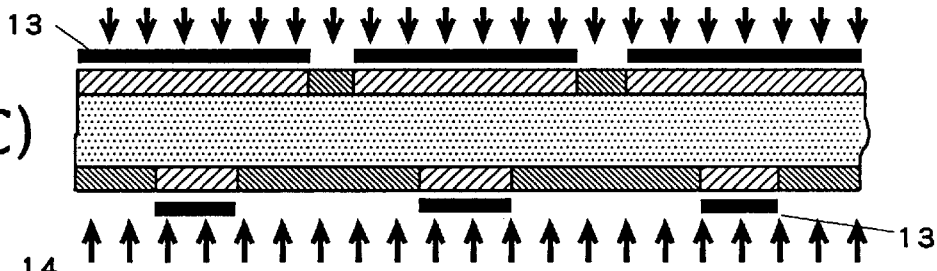
Figure 3D:
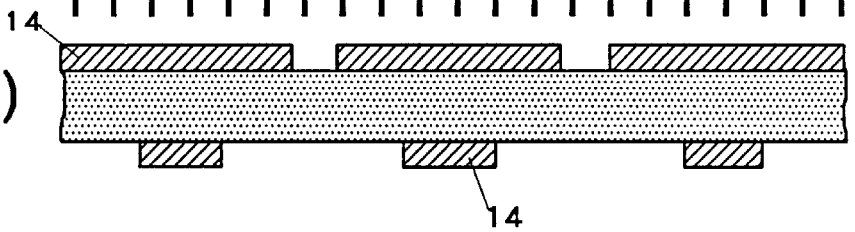
Figure 3E:
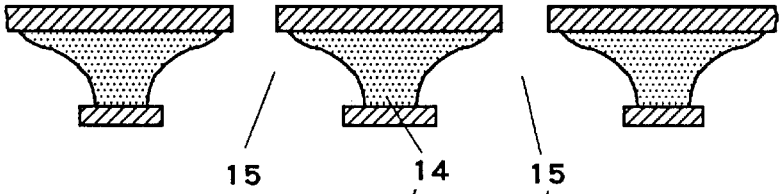
Figure 3F:
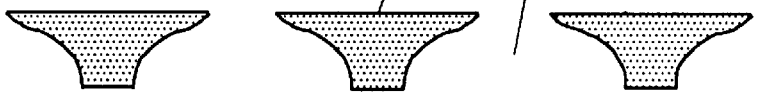
Figure 4A:
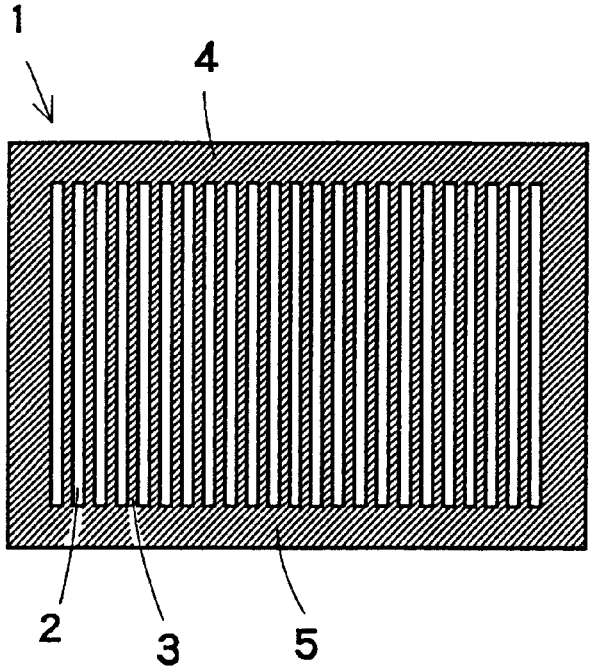
FIG.4(A) PRIOR ART
FIGS. 4(A) and (B) represent a conventional type aperture grille.
Figure 4B:
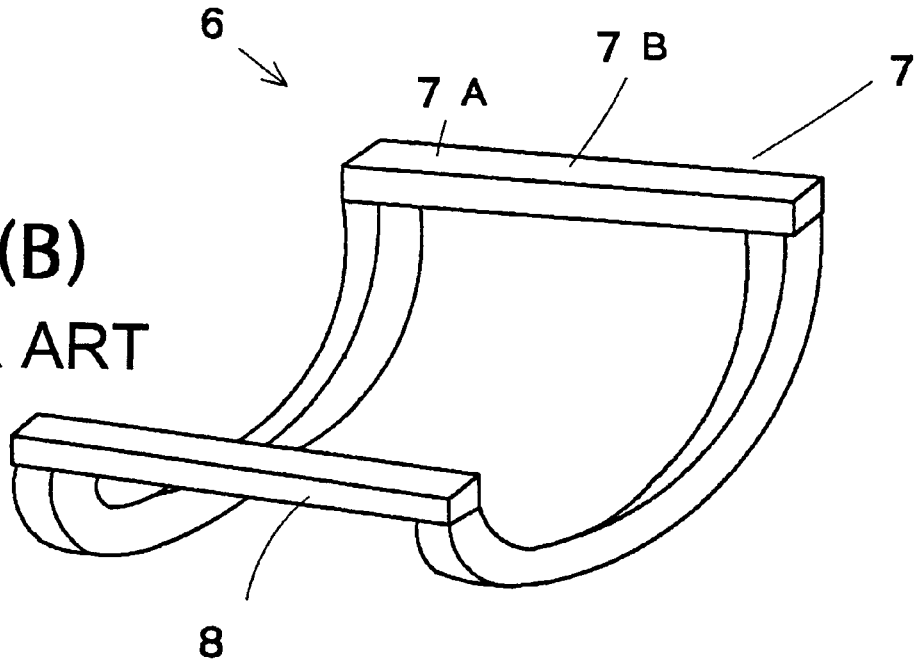
FIG.4(B) PRIOR ART

In general, resilient force of the frame body is lower at the central portion, and it is increased toward the peripheral portion. In an aperture grille having uniform cross-sectional area as a conventional type grid, when the aperture grille is mounted on the frame body, distribution of tensile strength is similar to the distribution of resilient force on the contrary, in the aperture grille of the present invention, as shown in FIG. 2(A), which represents distribution of resilient force o n the frame body of the aperture grille of the present invention, tensile strength is lower at the central portion and higher at peripheral portion. However, if cross-sectional area of the grid of the aperture grille is increased on peripheral portion than at the central portion as shown in FIG. 2(B) and the aperture grille is mounted on the frame body, it is possible to have uniform resilient force distribution as shown in FIG. 2(C). As a result, approximately equal tensile strength is applied on each grid at the central portion and on the peripheral portion of the aperture grille, and the aperture grille can be mounted with uniform tensile strength.

In the aperture grille of the present invention, difference between the width on the display surface side of the slit at the central portion and the width at the peripheral portion differs according to the difference of thickness of base material of the aperture grille, or to difference of rigidity of the frame body with the aperture grille mounted on it, or to the shape formed from the base material. For example, it is possible to design in such manner that a slit with normal width is provided on the display surface side and on the opposite side, and the width of the grid on the display surface side is 30 to 50 $\mu$m at the central portion and on the peripheral portion.

Description will be given now on an example of the manufacturing method of the aperture grille of the present invention referring to FIGS. 3(A)–3(F).

A thin plate 11 made of mild steel, invar, etc. is washed (A), and a resist 12 such as casein, polyvinyl alcohol, etc. is coated on both sides of the thin plate (B), and using a photomask 13 with etching pattern on it, the resist is exposed to light (C). The etching pattern is designed in such manner that width of the slit formed on the display surface side is larger and width of the slit on the rear side is smaller. Next, processing such as hardening treatment, baking, etc. is carried out, and development is performed using warm water in case of water-soluble resist, and a resist pattern 14 is formed (D). Then, etching solution is sprayed from both sides, and the pattern is etched, apertures 15 are formed (E), and the resist is detached after etching (F). Curved surface connecting slits on front and rear sides can be adjusted by changing pattern width and etching condition.

EXAMPLE

In the following, description will be given on an example of the present invention.

On both sides of a base material with thickness of 100 $\mu$m and made of low carbon steel, water-soluble casein resist was coated. After drying, slit-like patterning of the resist was performed using a pair of glass dry plates with patterns on front and rear surfaces. The front and rear patterns used in this case were in form of slit having the same width in longitudinal direction. The width of the pattern on the display surface side was gradually decreased from the central portion toward outer periphery, and there was difference of 40 $\mu$m between the central portion and the outer peripheral portion.

Next, processing was performed such as exposure to light, hardening treatment, baking, etc. Then, on the side of the resist processed with patterning, ferric chloride solution (solution temperature 60° C.; specific gravity 48° Be) was sprayed through spray nozzle as etching solution, and etching was performed.

After etching, it was washed with water, and the resist was detached using alkaline aqueous solution, and it was further washed and dried.

As a result, the width of the slits on the rear side was made the same as the conventional product, and cross-sectional area of the grid on outer peripheral portion was made by 50% larger than that of the grid at the central portion.

By relatively simple processing to have width of the slit at the central portion larger than the slit on the peripheral portion of the display surface side of the aperture grille, it is possible to attain adequate distribution of cross-sectional area of the grid on the aperture grille. When the aperture grille is mounted, it is possible to have approximately uniform resilient force distribution.

What we claim is:

1. An aperture grille having rows of single parallel slits defined therein, characterized in that a width of each slit on a display surface side and a rear side of the aperture grille is constant in a longitudinal direction, and a width of each slit on the display surface side is designed smaller on a peripheral portion of said aperture grille than at a central portion of said aperture grille so that a cross-sectional area of each grid of the aperture grille is made larger on the peripheral portion than at the central portion, and wherein the width on the rear side of any slit is substantially equal to the width on the rear side of any other slit.

* * * * *